United States Patent [19]

Simons

[11] 4,366,378

[45] Dec. 28, 1982

[54] LASER LIGHT DETECTION SYSTEM

[75] Inventor: Brent S. Simons, Palo Alto, Calif.

[73] Assignee: Itek Corporation, Lexington, Mass.

[21] Appl. No.: 114,771

[22] Filed: Jan. 23, 1980

[51] Int. Cl.[3] ..... H01J 40/14

[52] U.S. Cl. ..... 250/214 AG; 250/214 B

[58] Field of Search .... 250/214 A, 214 AG, 214 RC, 250/214 C, 208, 209, 214 B; 307/311; 356/218, 221; 244/3.16, 3.17

[56] References Cited

U.S. PATENT DOCUMENTS 3,761,185 9/1973 Blackwell ..... 250/214 R 4,061,925 12/1977 Van der Gaag et al. ... 250/214 AG 4,174,177 11/1979 Gardner et al. ..... 250/214 B

*Primary Examiner*—David C. Nelms

*Attorney, Agent, or Firm*—Homer O. Blair; Robert L. Nathans; Gerald H. Glanzman

[57] ABSTRACT

An adaptive gain integrator circuit is provided having a first integrator for producing an output which is proportional to the ambient light noise level and the amplitude of the laser illumination signals applied thereto. A second feedback circuit having a noise-only integrator is provided to maintain the noise level applied to the first integrator substantially constant despite wide variations in the amplitudes of ambient light detected by the system, thereby to reduce the false alarm rate and increase the sensitivity of the system.

9 Claims, 1 Drawing Figure

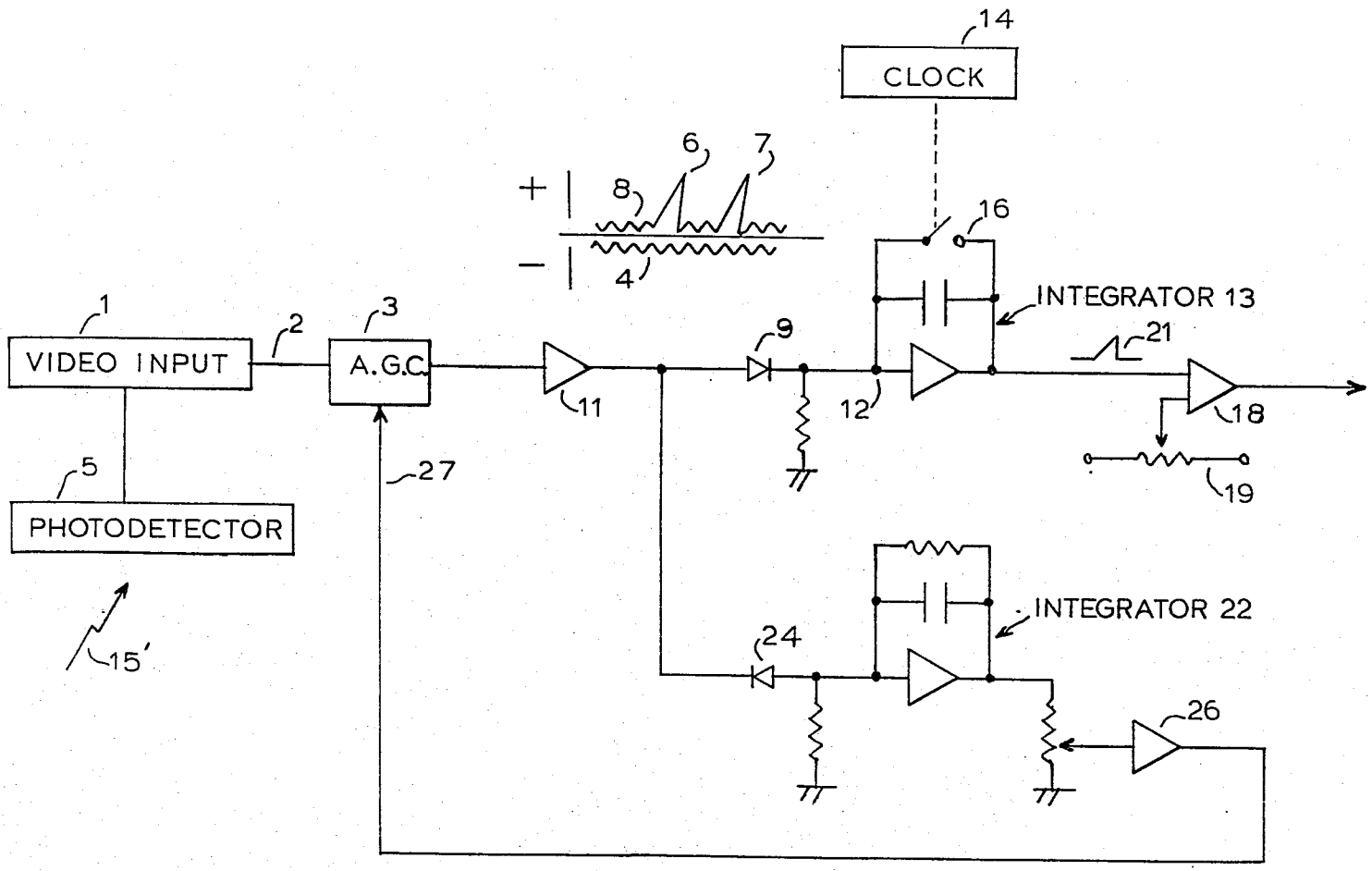
CLOCK
14
16
INTEGRATOR 13
21
18
19
INTEGRATOR 22
26
12
9
24
7
6
8
4
+
−
11
A.G.C.
3
27
2
VIDEO INPUT
1
PHOTODETECTOR
5
15'

LASER LIGHT DETECTION SYSTEM

TECHNICAL FIELD

This invention relates to the field of pulse detection.

BACKGROUND OF THE INVENTION

In accordance with a known technique, short laser impulses illuminating an aircraft during radar surveillance are detected by providing a photodetector which produces electrical impulses which are amplified and fed to the input circuit of an integrator. These impulses consist of signal impulses, one being produced for each burst of laser light detected by the photodetector, together with noise impulses due to ambient light such as sunlight and sunlight reflection from, for example, helicopter rotor blades. Should an integrator integrate noise and signal impulses during a time interval of for example, 0.1 seconds, a ramp voltage is produced having a final amplitude at the end of the interval which is proportional to the integral of the noise and signal impulses of one polarity. Upon the commencement of the receipt of laser signal impulses, the final integrator ramp voltage will increase above a given threshold voltage to provide for the detection of the laser illumination. By applying such ramp voltage to the input circuit of comparator, a comparator output signal may be produced indicating the fact that signal (laser) impulses are present, since the final ramp voltage will exceed a reference threshold voltage.

However, the photodetector output may change, typically 4–1, between shade and full sunlight, which may cause the integrator to saturate, which in turn causes the comparator output to be unreliable as a high noise level may be mistaken for signal impulses due to laser illumination.

It is an object of the present invention to provide detection circuitry having improved sensitivity and reliability relative to the technique explained above.

It is a further object of the invention to provide a sharply reduced false alarm rate and to permit smaller and less expensive photodiodes to be used in detecting certain high pulse repetition frequency laser threats, regardless of the presence of a widely varying noise background.

SUMMARY OF THE INVENTION

The above mentioned problems have been solved in accordance with a preferred embodiment of the invention by providing a second integrator which, in contrast with a signal plus noise integrator, integrates noise only to develop a DC output level proportional to the noise level, which output level is fed back to an automatic gain control means coupled between the video input circuit and the first integration means to alter the gain in a manner to maintain the noise level signal applied to the first integrator constant.

Other objects, features, and advantages of the present invention will become apparent upon study of the following description taken in conjunction with the sole FIGURE which illustrates an embodiment of the invention.

BRIEF DESCRIPTION OF THE DRAWING

The sole FIGURE illustrates a circuit diagram of an embodiment of the invention.

DETAILED DESCRIPTION

In the sole FIGURE, video input circuit 1 is coupled to input lead 2 of automatic gain control (AGC) means 3 which could employ a field effect transistor. Photodetector 5 converts laser light impulses 15 to electrical signals fed to video input 1. The signal impulses applied to AGC circuit 3 could typically have a duration of 50 nanoseconds and a pulse repetition frequency of 2-kHz, where the present invention is employed to detect certain types of laser illumination impulses. The output signal of AGC 3 is illustrated at 4, and the signal impulses 6 and 7 may be seen riding above the noise impulses 8. The signal impulses, in contrast with the noise impulses, extend positively, but are not negative going owing to the biasing of AGC circuit 3. A first uni-directional impedence circuit 9 and video amplifier 11 are coupled in tandem between the input circuit 12 of first integrator 13 and the output circuit of AGC 3 as illustrated. Such uni-directional impedence means would typically include a diode having a polarity which causes both the positive going signal impulses 6 and 7 and the positive going noise signals 8 to be integrated by integrator 13, but not the negative noise signals. In the contemplated environment of this invention, integrator 13 would integrate during a 0.1 second interval and become reset during a 1 millisecond interval, pursuant to the operation of clock 14 which controls switch means 16; the integrator being reset upon the brief closure of switch means 16. Upon the opening of switch means 16, the aforesaid ramp voltage is produced having a terminal amplitude which is proportional to the amplitudes of signal impulses 6 and 7, for a given pulse repetition frequency. Comparator 18, having reference threshold device 19 such as a potentiometer, produces an output signal should the final amplitude of the ramp voltage represented by pulse diagram 21 exceed a predetermined threshold as previously explained.

As set forth above, the photodetector noise output amplitude may change 4–1 between shade and full sunlight, thereby to cause first integration means 13 to saturate to produce a false alarm indication. This problem is overcome by providing second noise integration means 22 which, in contrast with integration means 13, only integrates the noise level rather than the signals.

Pursuant to this goal, a second uni-lateral impedence device 24 is coupled between the output circuit of AGC 3 via video amplifier 11. Since the polarity of device 24 is opposite the polarity of device 9 with respect to ground, the negative going impulses, which do not include signals 6 and 7, are integrated by the second integrator 22, the output of which is amplified by amplifier 26 and fed back to control lead 27 of AGC device 3. This feedback circuit causes a reduction in the gain of AGC 3 upon an increase in the noise level, thereby to maintain the noise level applied to the first integrator 13 substantially constant. Hence, the afore mentioned adverse effect caused by considerable variations in the level of noise upon integrator 13 is eliminated, and improved sensitivity and reliability is provided.

It should be understood that other components and configurations may be substituted for those described in order to practice the invention, and the invention is to be limited only by the permissable scope of the following claims. References are made in the claims to numbered components in the described embodiment, and it should be understood that the claims are not to be restricted to such embodiments, as the numbers employed in the claims are merely exemplary of the nature of the claimed means.

I claim:

1. Adaptive gain integrator circuit comprising:

a. input means (1) for producing signal impulses of a given polarity, intermixed with noise impulses;

b. automatic gain control means (3) having an output circuit, a control circuit, and an input circuit coupled to said input means;

c. first integration means (13) coupled to the output circuit of said automatic gain control means for integrating both said signal impulses and said noise impulses during a given period;

d. second integration means (22) coupled to the output circuit of said automatic gain control means for integrating said noise impulses but not said signal impulses during a given period;

e. comparator means (18) having an input circuit coupled to the output circuit of said first integration means for producing an output signal should the output of said first integration means exceed a pre-determined threshold level; and f. feedback means (26, 27) coupled to the output circuit of said second integration means for feeding a signal to said control circuit of said automatic gain control means proportional to the magnitude of the output signal of said second integration means, for maintaining the amplitudes of the noise impulses applied to said first integration means substantially constant.

2. The combination as set forth in claim 1 further including variable gain amplifier means (26) coupled between the output circuit of said second integration means and said control circuit of said automatic gain control means.

3. The combination as set forth in claims 1 or 2 further including first unidirectional impedence means (9) for passing pulses of a first polarity from the output circuit of said automatic gain control means and the input circuit of said first integration means, together with second unidirectional impedence means (24) coupled between the output circuit of said automatic gain control means and the input circuit of said second integration means for transmitting impulses of a second polarity, opposite said first polarity, from the output circuit of said automatic gain control means and the input circuit of said integration means.

4. A laser light detection system for detecting short bursts of light signals impinging thereon comprising:

a. photodetector means (5) for producing electrical signal impulses corresponding to detected flashes of light together with ambient light noise impulses of varying magnitude;

b. automatic gain control means (3) having an output circuit, a control circuit, and an input circuit coupled to said photodetector means;

c. first integration means (13) coupled to the output circuit of said automatic gain control means for integrating both said signal impulses and said noise impulses during a given time period;

d. second integration means (22) coupled to the output circuit of said automatic gain control means for integrating said noise impulses but not said signal impulses;

e. comparator means (18) having an input circuit coupled to the output circuit of said first integration means for producing an output signal should the output of said first integration means exceed a pre-determined threshold level; and f. feedback means (26, 27) coupled to the output circuit of said second integration means for feeding a signal to said control circuit of said automatic gain control means proportional to the magnitude of the output signal of said second integration means, for maintaining the amplitudes of the noise impulses applied to said first integration means substantially constant.

5. The combination as set forth in claim 4 further including variable gain amplifier means (26) coupled between the output circuit of said second integration means and said control circuit of said automatic gain control means.

6. The combination as set forth in claims 4 or 5 further including first unidirectional impedence means (9) for passing pulses of a first polarity from the output circuit of said automatic gain control means and the input circuit of said first integration means, together with second uni-directional impedence means (24) coupled between the output circuit of said automatic gain control means and the input circuit of said integration means for transmitting impulses of a second polarity, opposite said first polarity, from the output circuit of said automatic gain control means and the input circuit of said integration means.

7. A laser light detection system for detecting short bursts of light signals impinging thereon comprising:

a. photodetector means (5) for producing electrical signal impulses corresponding to detected flashes of light, together with ambient light noise impulses of varying magnitude;

b. automatic gain control means (3) having an output circuit, a control circuit, and an input circuit coupled to said photodetector means;

c. first integration means (13) coupled to the output circuit of said automatic gain control means for integrating both said signal impulses of a first polarity and said noise impulses of a said first polarity during a given time period;

d. second integration means (22) coupled to the output circuit of said automatic gain control means for integrating said noise impulses of a second polarity opposite said first polarity but not said signal impulses during a given time period;

e. comparator means (18) having an input circuit coupled to the output circuit of said first integration means for producing an output signal should the output of said first integration means exceed a pre-determined threshold level; and f. feedback means (26, 27) coupled to the output circuit of said second integration means for feeding a signal to said control circuit of said automatic gain control means proportional to the magnitude of the output signal of said second integration means, for maintaining the amplitudes of the noise impulses applied to said first integration means substantially constant.

8. The combination as set forth in claim 7 further including variable gain amplifier means (26) coupled between the output circuit of said second integration means and said control circuit of said automatic gain control means.

9. The combination as set forth in claims 7 or 8 further including first unidirectional impedence means (9) for passing pulses of a first polarity from the output circuit of said automatic gain control means and the input circuit of said first integration means, together with a second unidirectional impedence means (24) coupled between the output circuit of said automatic gain control means and the input circuit of said second integration means for transmitting impulses of a second polarity, opposite said first polarity, from the output circuit of said automatic gain control means and the input circuit of said integration means.

* * * * *